US007040583B1

(12) United States Patent
Holland et al.

(10) Patent No.: US 7,040,583 B1
(45) Date of Patent: May 9, 2006

(54) SUPPORT STAND FOR HOLDING DISPLAY ITEMS

(76) Inventors: Edward W. Holland, 339 Lupe Ave., Newbury Park, CA (US) 91320; Marie L. Anderson, 339 Lupe Ave., Newbury Park, CA (US) 91320

( * ) Notice: Subject to any disclaimer, the term of this patent is extended or adjusted under 35 U.S.C. 154(b) by 951 days.

(21) Appl. No.: 08/992,504

(22) Filed: Dec. 17, 1997

(51) Int. Cl.
*A47F 5/00* (2006.01)

(52) U.S. Cl. ..... 248/122.1; 248/226.11

(58) Field of Classification Search ..... 248/216.4, 248/217.2, 227.2, 227.3, 227.4, 226.11, 121.1, 248/218.4, 220.21, 224.8, 274.1, 309.1, 310, 248/313, 316.1, 316.4, 346.03, 346.07, 451, 248/448, 449, 519, 551; 177/262; 211/42; D19/34.1
See application file for complete search history.

(56) References Cited

U.S. PATENT DOCUMENTS 807,613 A * 12/1905 Graves ..... 248/346.07
1,396,910 A * 11/1921 Annable ..... 40/642.02
1,598,467 A * 8/1926 Weeks ..... 211/43
1,682,060 A * 9/1928 Banks ..... 211/43
1,715,722 A * 6/1929 Smith et al. ..... 269/133
1,780,872 A * 11/1930 Dumben ..... 108/28
2,453,207 A * 11/1948 Dunn ..... 248/316.4
2,713,471 A * 7/1955 Hirsch ..... 248/346.03
2,812,918 A * 11/1957 Longino ..... 248/316.4
3,425,565 A * 2/1969 Sprenger ..... 211/43
3,679,064 A * 7/1972 Howkinson ..... 211/43
D225,500 S * 12/1972 Lewis ..... D6/106
3,861,662 A * 1/1975 Morse ..... 269/17
4,323,226 A * 4/1982 Close ..... 248/224.8
4,458,874 A * 7/1984 Rabas et al. ..... 248/670
4,515,195 A * 5/1985 Gladstein ..... 248/519
4,637,632 A * 1/1987 Rubash et al. ..... 281/45
4,966,340 A * 10/1990 Hunter ..... 248/125
5,149,032 A * 9/1992 Jones et al. ..... 248/313
5,169,114 A * 12/1992 O'Neill ..... 248/551
5,192,046 A * 3/1993 Howard ..... 248/676
5,685,518 A * 11/1997 Fox et al. ..... 248/523
5,768,733 A * 6/1998 Kneebone ..... 14/69.5
5,822,918 A * 10/1998 Helfman ..... 248/231.41

* cited by examiner

*Primary Examiner*—Robert P. Olszewski
*Assistant Examiner*—Alfred Joseph Wujciak, III
(74) *Attorney, Agent, or Firm*—Lyon & Harr, LLP; Mark A. Watson

(57) ABSTRACT

A stand for supporting display items of a flat plane type in a vertical position, and of the type having a ground engaging flat base plate (10) a fixed vertical support member with a flat planar surface (20) and an adjustable vertical support member (24) which is L-shaped, has a flat planar surface and has a guide slot (26) in its base portion, and is of sufficient height to prevent tipping of the display item. The guide slot (26) is placed over a fixed guide pin (12) and a fixed threaded guide pin (14) in the base plate (10), allowing the adjustable vertical support member (24) to be slidably moved in relationship to the fixed vertical support member (20) such that a variable aperture is created between the two vertical supports, allowing flat display items of varying thickness to be placed between those supports. By tightening an adjustment knob (18) down onto the threaded guide pin (14), the adjustable vertical support member (24) may be temporarily fixed in position, trapping and securely holding the display item in a vertical position between the supports.

24 Claims, 4 Drawing Sheets

SUPPORT STAND FOR HOLDING DISPLAY ITEMS

BACKGROUND—FIELD OF INVENTION

This invention relates to support stands, specifically to such stands used for supporting display items of a flat plane type in a vertical position.

BACKGROUND—DESCRIPTION OF PRIOR ART

Hotels, Banquet Centers, Rental Companies and Decorators commonly supply consumers with display items of a flat plane type, such as a sheet of lattice or foam-core board to decorate and accent their special events, to act as a divider, sign or backdrop, or to block certain items from view. Such items often require a support device or support stand to hold them in a vertical position. Displays, dividers, or decorations need to be set up and taken down quickly, may be required indoors or outdoors, may need to be moved during an event, and may have pedestrian foot traffic on either side of the display. Therefore, the support stands must be freestanding, unobtrusive, low to the ground, and weather-resistant. Additionally, they must function without attachment to the floor, walls or ceiling, and without weights, cables or sandbags.

Due to the lack of a commercially manufactured support stand, attempts have been made to make support stands out of wood, typically 2"×4" lumber, with a horizontal board serving as a base and two attached vertical boards, between which the display item is held. Attempts have also been made to use right-angle shelf brackets by fastening them with screws to the front and back of a display item at the bottom edge to hold it in a vertical position; this arrangement often requires sandbags or concrete blocks for stability.

After extensive searches both in the commercial and public sectors for items that would serve the purpose, no similar support stand was found.

Although support bases made of wood or shelf brackets can be used to support flat display items, all the support stands heretofore known suffer from several disadvantages.

(a) To be of sufficient strength, the wooden support stand must be constructed with boards having substantial thickness, making the support stand unsightly and excessive in size, also creating a trip hazard to pedestrian traffic.

(b) The wooden support stand has natural flaws, being made of organic material, and is subject to damage from insects and deterioration due to age, becoming a safety concern over time.

(c) The wooden support stand is susceptible to the effects of weather. Heat and dryness can cause the wooden stand to shrink, resulting in a loose fit, with the supported object becoming unsteady. Humidity or rain can cause the wooden stand to warp or swell, resulting in a tight fit, trapping the display item in the stand or causing damage to the item during insertion and removal. Cold can cause the wooden stand to split, resulting in damage to the display item caused by the untimely collapse of the stand.

(d) Wooden support stands are usually assembled with screws or nails, and are therefore difficult to adjust for display items of varying thickness.

(e) For right-angle metal shelf brackets to serve as support stands, they must be used in pairs opposite each other, being fastened to the bottom of the display item with screws. If the brackets remain attached, the display item becomes difficult to store and transport; if they are repeatedly removed and reattached, the display item becomes damaged by multiple screw holes.

(f) Right-angle metal shelf brackets require tools, fasteners and time-consuming labor to attach to the display item.

OBJECTS AND ADVANTAGES

Accordingly, several objects and advantages of the present invention are:

(a) to provide a support stand that will hold flat panel display items, such as lattice panels, signs, murals, photographs or graphic designs, in a vertical position to function as a screen, divider, backdrop or display;

(b) to provide a support stand with a continuous ground engaging flat base of sufficient dimension, weight, strength and stability to hold a flat display item, while remaining unobtrusive, low to the ground, and presenting no trip hazard to foot traffic;

(c) to provide a support stand with vertical upright supports of sufficient height and with flat planar surfaces that are always perpendicular to the base, which will communicate with and hold a flat display item in a stable, vertical position without tipping;

(d) to provide a support stand that is strong, durable, and reliable, which will not deteriorate with age;

(e) to provide a support stand that is dimensionally stable, which will not be affected by temperature or humidity;

(f) to provide a support stand that is easily and infinitely adjustable to the thickness of various display items, which will hold different thickness items with equal stability;

(g) to provide a support stand that can be adjusted to the display item quickly, which does not require the use of tools to adjust, install or remove display items, and which does not require the removal of the display item or inversion of the stand to be adjusted for thickness, which exerts minimal pressure on the display item to avoid marring or damage, and which does not rely on the weight of the display item to hold the upright supports in place;

(h) to provide a support stand that can easily be separated from the display item without having to remove and replace screws, allowing the display item to be stored efficiently, and avoiding damage to the display item caused by the use of screws to fasten the stand to the item; and, (i) to provide a support stand that allows the optional use of screws to fasten the display item when additional stability is required.

Further objects and advantages are to provide a support stand that can be used easily by one person, which will not damage the display item, which is simple to use and manufacture, which can be used repeatedly, and one that presents an attractive and professional appearance. Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

Figure 1A:
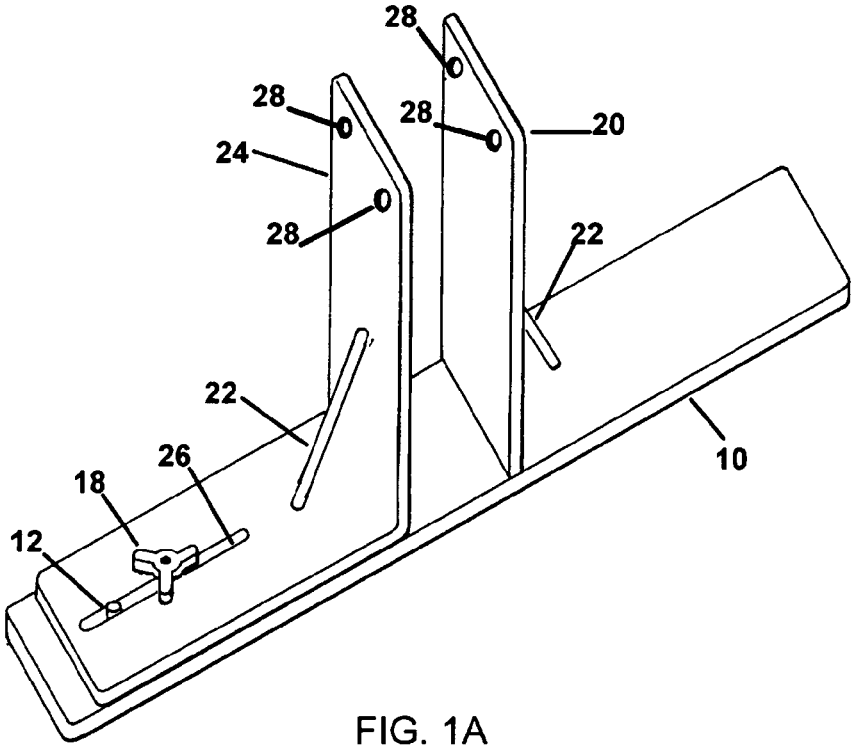
FIGS. 1A to 1C show various aspects and application of a support stand with a continuous ground engaging flat base and one or several adjustable vertical support members with flat planar surfaces.

10 Continuous ground engaging flat base plate
12 fixed guide pin
14 fixed threaded guide pin
16 countersunk hole
18 tri-spoked adjustment knob
20 fixed vertical support member with flat planar surface
22 support rod
24 adjustable L-shaped vertical support member with flat planar surface
26 guide slot
28 screw hole
30 flat washer
32 lock washer

SUMMARY

In accordance with the present invention a support stand for holding flat panel display items in a vertical position comprises a continuous ground engaging flat base plate which communicates with a floor or ground surface, having sufficient length and weight to prevent the held item from tipping over, with two reinforced L-shaped vertical support members, which may be non-fixed or permanently fixed, each with a continuous flat planar upright surface which is perpendicular to the base plate to communicate with the surface of the flat display item being held without damaging the display item, as well as a continuous bottom portion to communicate with the ground engaging flat base plate, such support members being of sufficient height to prevent a tall display item from tipping over, a means of sliding one or both vertical support members toward or away from one another to adjust for thickness of the item being held, such that the adjustment is infinitely variable from a completely closed position to the maximum dimension, and a temporary means of holding one or both vertical support members in position, which can be effected without the use of tools, without inverting the stand, without removing the display item from the stand, and without relying on the weight of the item being held to hold the uprights in place.

Description—FIGS. 1 to 5

Figure 1B:
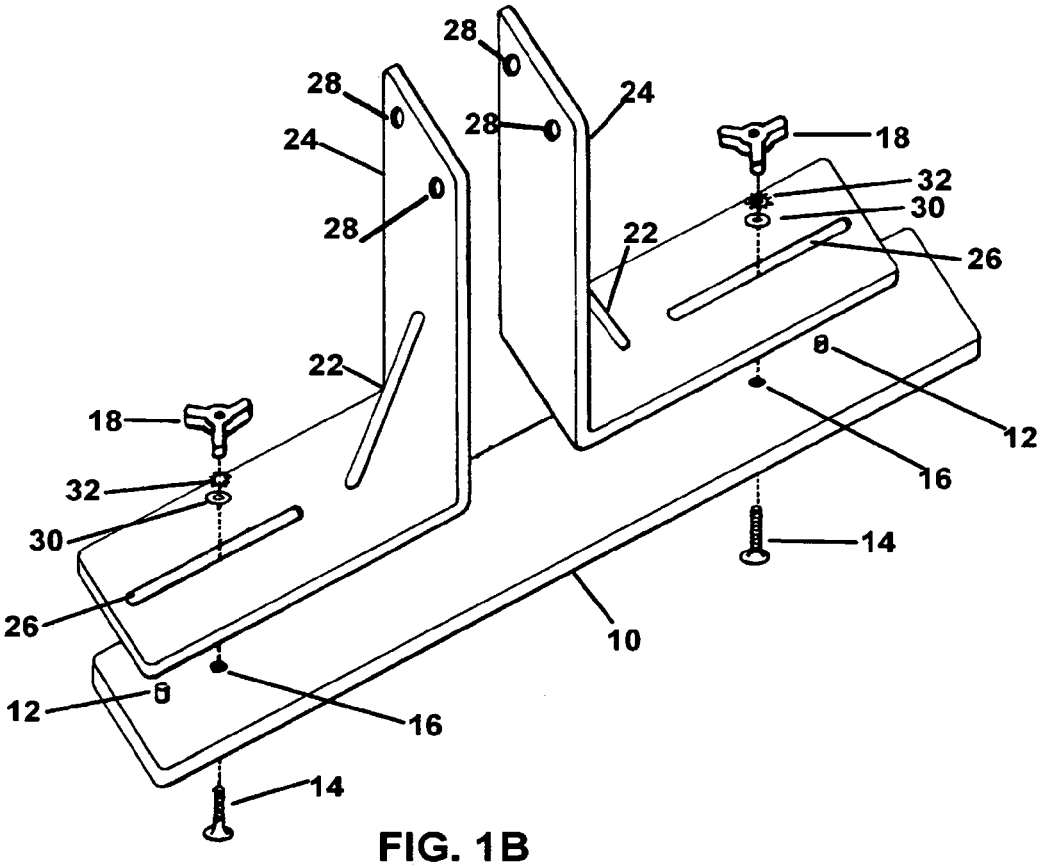
Figure 1C:
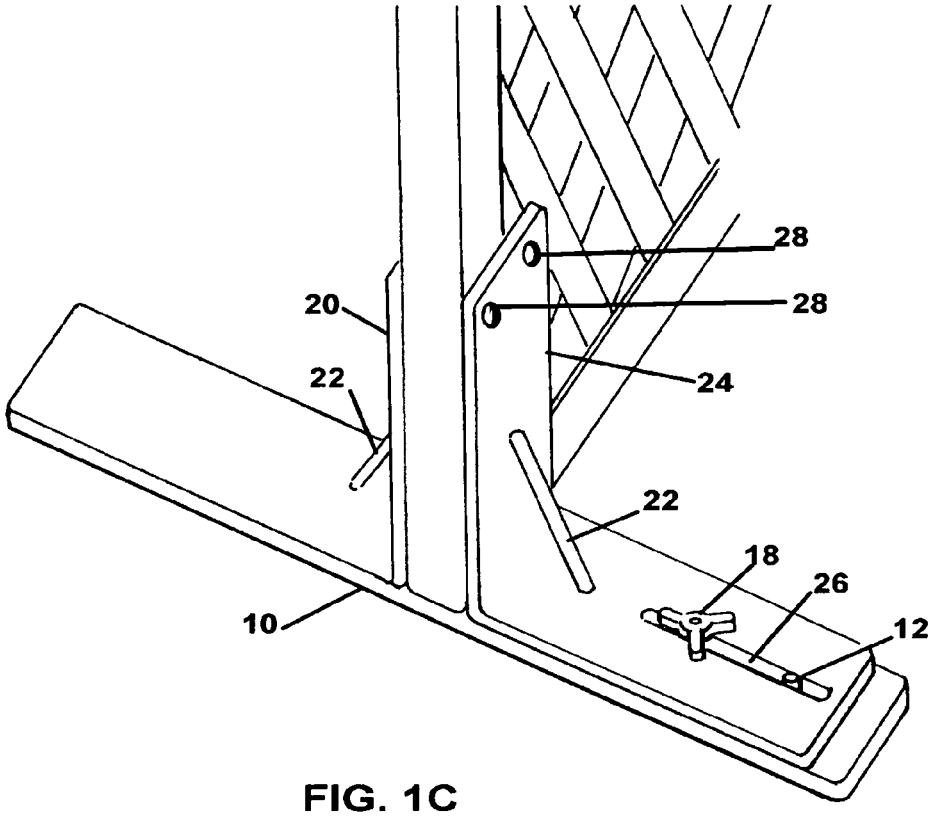

A typical embodiment of the support stand of the present invention is illustrated in FIG. 1A, FIG. 1B (exploded view), and FIG. 1C (typical usage). The stand has a continuous ground engaging flat base plate 10 of an elongated square or rectangular shape of uniform cross section consisting of metal, coated with a rust-resistant plating material, to provide high strength, substantial weight, and dimensional stability to communicate with a floor or ground surface and prevent tipping of the held item. In one embodiment, a permanently fixed vertical support member 20 with a flat planar surface perpendicular to base plate 10 is permanently attached to base plate 10 at approximately its center point, and reinforced by means of a support rod 22 welded to both the base plate 10 and fixed support 20 at a 45-degree or other sufficient angle across the right angle formed by the outer intersection of base plate 10 and fixed support 20. An additional, non-fixed adjustable vertical support member 24 describes an L-shape with a guide slot 26 in the base portion of that L-shape, the base portion of the support having a continuous flat planar surface to communicate with base plate 10, and the upper portion of the support having a flat planar surface perpendicular to base plate 10 to communicate with the flat surface of the item being held. Permanently fixed support 20 and additional non-fixed adjustable support 24 are made of metal, coated with a rust resistant plating material. Non-fixed, adjustable support 24 lies flat on top of base plate 10, such that guide slot 26 fits over a fixed guide pin 12 and a fixed threaded guide pin 14 (FIG. 1B), both of which extend upward from base plate 10. Fixed guide pin 12 and fixed threaded guide pin 14 effectively guide the movement of non-fixed adjustable support 24 by restricting it to a path aligning with the long dimension of base plate 10 also keeping it parallel with fixed support 20, such that non-fixed adjustable support 24 can be moved toward or away from permanently fixed support 20, and is infinitely adjustable from a completely closed position to maximum width, remaining perpendicular to base plate 10 at any point of adjustment. Fixed guide pin 12 is permanently attached to base plate 10. Threaded guide pin 14 inserts through a countersunk hole 16 in the base plate 10, and is also permanently attached to base plate 10. A tri-spoked adjustment knob 18 having a threaded insert, can be screwed down onto threaded guide pin 14 without the use of tools, to hold adjustable support 24 in a fixed position when tightened. A flat washer 30 and a lock washer 32 are placed over threaded guide pin 14 to prevent slippage. A screw hole 28 is provided in two locations at the upper end of non-fixed adjustable support 24 and permanently fixed support 20, to allow optional installation of screws for additional stability. In the preferred embodiment, the base, adjustable non-fixed and permanently fixed vertical support members, support rods, fixed alignment pins and threaded alignment pins are zinc-plated steel, and the adjustment knobs are molded ABS plastic with threaded brass inserts. However, the support stand can consist of any metal that is strong, heavy, resists corrosion, and can be easily machined, punched, bent or welded without losing its strength. The adjustment knob may consist of any material that can be threaded or hold a threaded insert.

Figure 2:
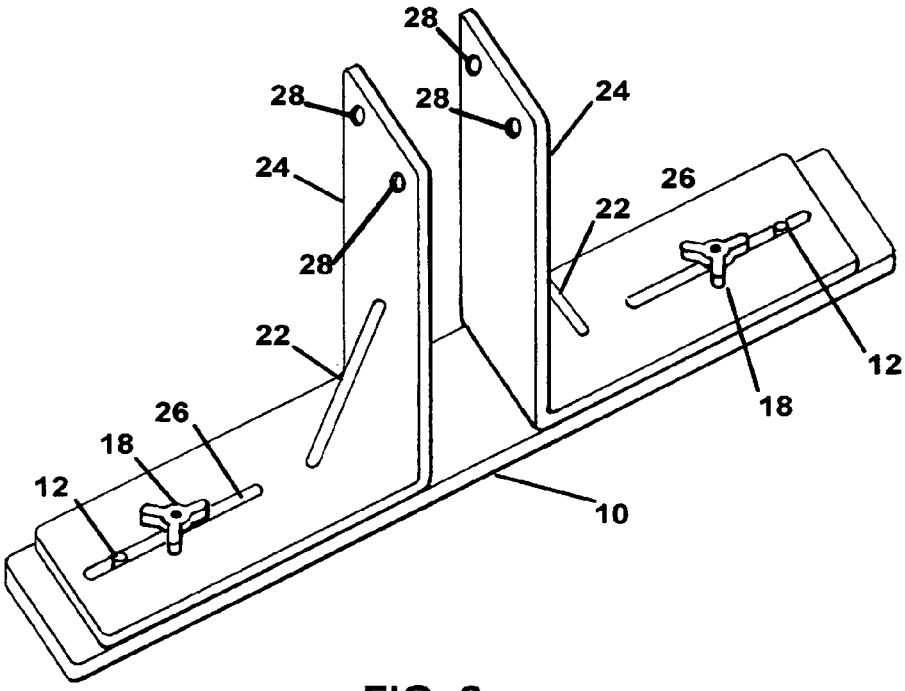
FIG. 2 shows a support stand with a continuous ground engaging flat base and two adjustable vertical support members with flat planar surfaces.
Figure 3:
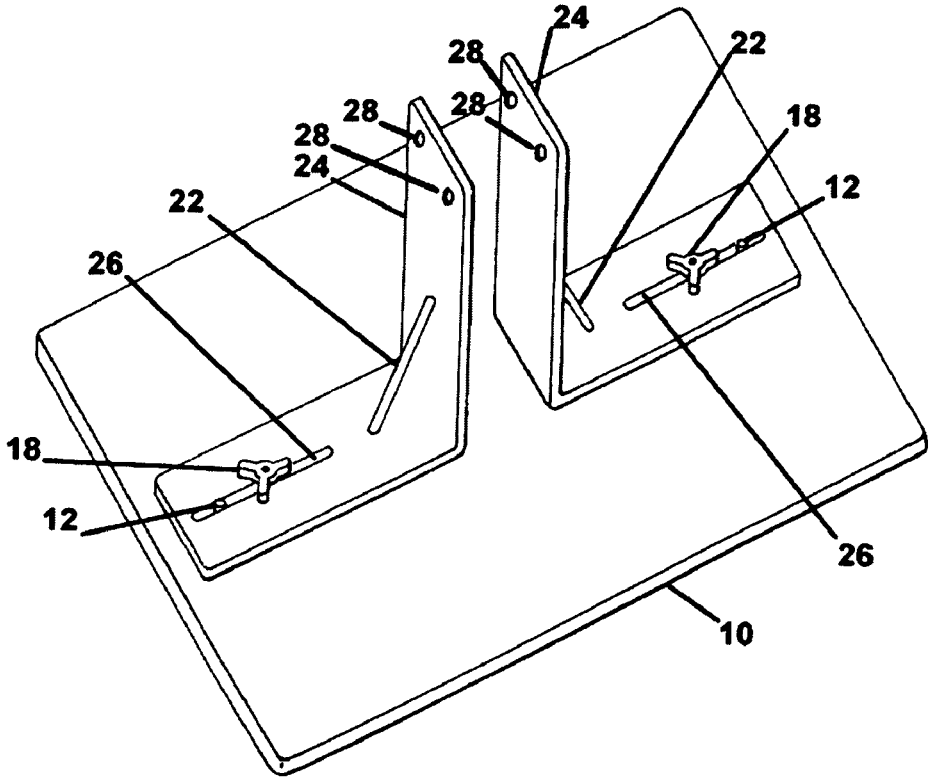
FIG. 3 shows a similar support stand with a square-shaped ground engaging flat base.
Figure 4:
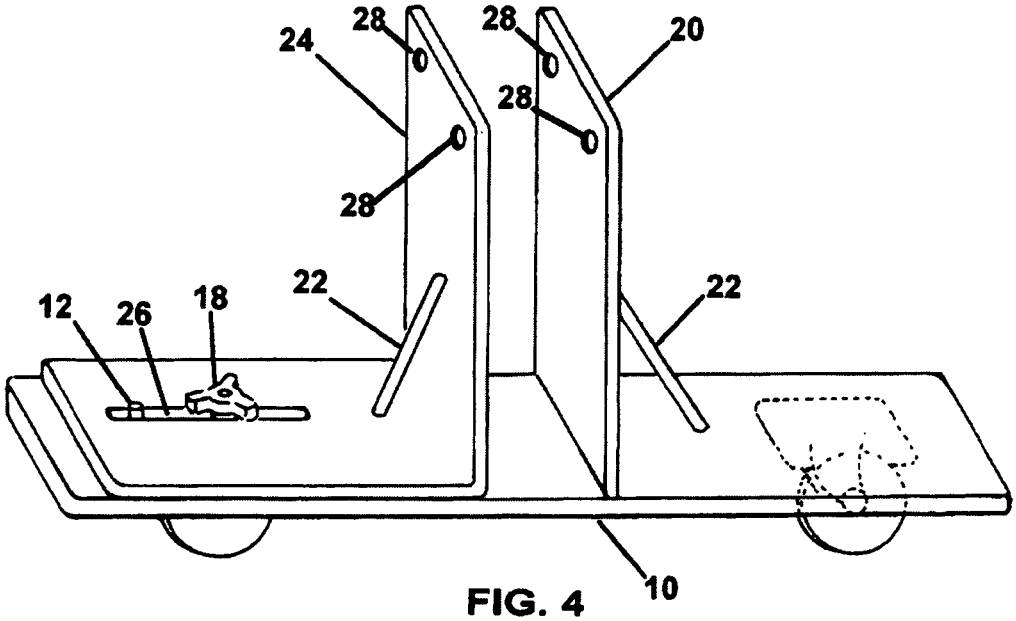
FIG. 4 shows a similar support stand with wheels attached to the base.
Figure 5:
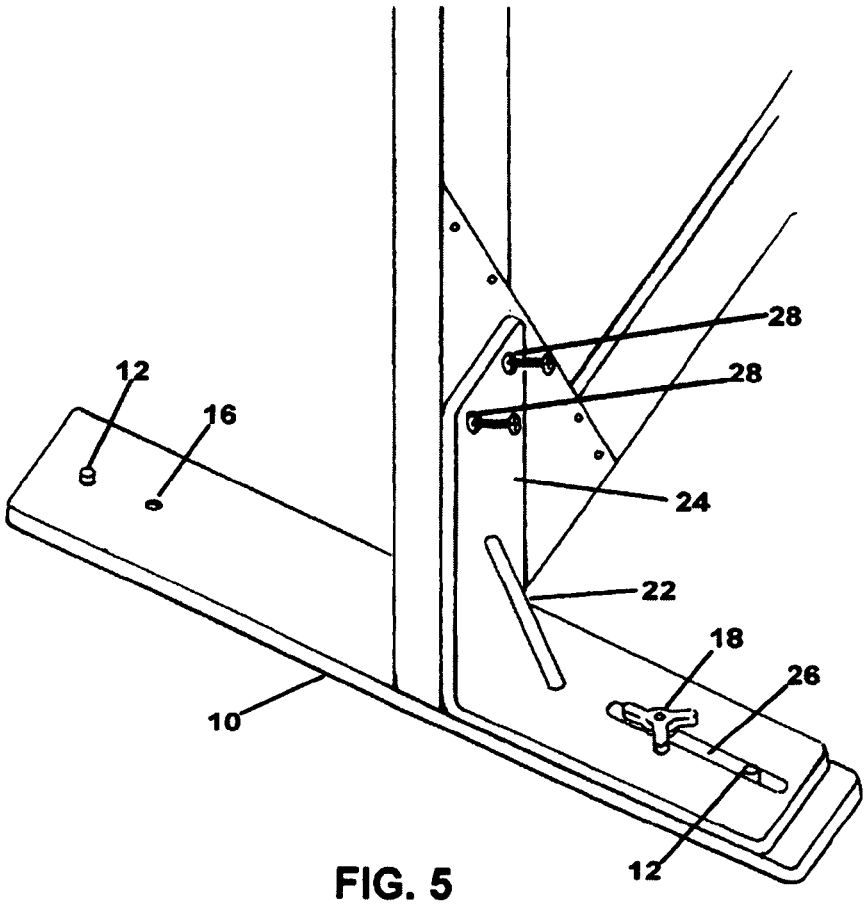
FIG. 5 shows a similar support stand with one flat vertical support member attached to a display item.

Additional embodiments are shown in FIGS. 2, 3, and 5. In FIG. 2 the support stand has two adjustable non-fixed vertical support members. In FIG. 3 the support stand base plate is square, rather than elongated. In FIG. 4 wheels are attached to the base plate for mobility. In FIG. 5 only one permanently fixed vertical support member is used, and it is attached to the display item by inserting screws through the two screw holes.

From the description above, many advantages of our support stand become evident:

(a) The support stands can be placed on the floor or other flat surface and adjusted to the approximate thickness of the display item. The display item can be quickly dropped into position and the adjustable supports can be tightened to hold the display item securely in a vertical position.

(b) Support stands can be used to hold display items in the middle of a room without the risk of people tripping over bulky supports, sandbags or blocks.

(c) Support stands can be used or stored outdoors without warping or cracking.

(d) Support stands and displays can be assembled by unskilled labor without tools.

Operation—FIGS. 1A, 1C

The manner of using the support stands to hold a vertically-oriented flat plane display item is similar to that for wooden stands presently in use. Arrange a pair of support stands on the floor or flat surface in the approximate position where the display is required, such that each support stand will be positioned at one end of the display item. The elongated dimension of each base plate 10 is parallel to the other, and perpendicular to the display item. Next, place the display item into the support stands, between adjustable vertical support member 24 and fixed vertical support member 20 on each support stand. The vertical support members act similarly to the halves of a vise or a caliper, trapping the display item in a vertical orientation with only minimal pressure to avoid damage to or marring of the display item. Hold the display item up against fixed support 20 on the first support stand, and slide adjustable support 24 fully toward the display item. Tighten adjustment knob 18 until adjustable support 24 is held in place, then repeat the procedure for the second support stand.

To remove the display item, loosen adjustment knob 18 on the first support stand and slide adjustable support 24 away from the display item. While holding the display item steady, repeat the procedure with the second stand. Additional sets of support stands and display items may be located adjacently to one another to provide a divider, backdrop, screen, or display of any length required.

SUMMARY, RAMIFICATIONS AND SCOPE

Accordingly, the reader will see that the support stand can be used to hold a flat plane display item, with adjustable uprights that allow the display item to be inserted into and removed from the stand quickly and conveniently. Furthermore the support stand has additional advantages in that:

- it permits quick assembly of the display item and stand without using any tools;
- it permits insertion and removal of the display item without damaging the display item;
- it provides exceptional stability without requiring the use of screws to hold the display item to the support stand, or without requiring any additional attachment to the ceiling, floor or walls;
- it holds the display item in a freestanding manner without presenting a trip hazard;
- it allows use in the middle of an open area without providing a visually unattractive appearance;
- it allows outdoor use without being subject to deterioration due to the effects of temperature or humidity;
- it provides more stability than any previous method used to hold flat plane display items; and;
- its operation is non-dependent on the weight of the display item.

Although the description above contains many specificities, these should not be construed as limiting the scope of the invention, but merely as providing illustrations of some of the presently preferred embodiments of this invention. For example, the base plate can have other shapes, such as circular, oval, trapezoidal or triangular; the support rod can be square, a flat bar, or a triangular piece.

Thus, the scope of the invention should be determined by the appended claims and their legal equivalents, rather than by the examples given.

We claim:

1. A support stand, comprising:

a flat, planar, rigid base;

a pair of support members disposed on a top surface of the base, each support member having a single, planar holding surface oriented so as to be substantially perpendicular to the top surface of the base and opposed to each other, and wherein a first of the pair of support members is slidably engaged with the top surface of the base such that the holding surface of the first support member can be slid toward or away from the holding surface of the second support member;

a securing apparatus capable of releasably securing the first support member to the base so as to prevent relative motion between that member and the base;

wherein the first support member comprises an L-shaped bracket, a first leg of which extends substantially perpendicular to the base and has a face which forms the planar holding surface of the first support member, and a second leg of which has a face which is slidably engaged with the top surface of the base; and wherein the second leg of the first support member comprises a slot oriented so as to be substantially perpendicular to the face forming the planar holding surface of the first support member, and wherein the securing apparatus comprises, a threaded pin protruding substantially perpendicular from the top surface of the base which has a distal end that extends through the slot of the first support member, and a threaded knob which is threadably mated to the threaded pin and which in a disengaged mode allows the first support member to be slid in relation to the base, and in an engaged mode wherein the knob is rotated down on the pin so as to compress the second leg of the first support member against the top surface of the base, prevents the first support member from sliding in relation to the base.

2. The support stand of claim 1, wherein the second support member is permanently affixed to the base.

3. The support stand of claim 1, further comprising a second pin protruding substantially perpendicular from the top surface of the base which has a distal end that extends into the slot of the first support member, whereby the second pin prevents rotation of the first support member about the threaded pin.

4. The support stand of claim 3, wherein the second pin is disposed further outward on the base than the threaded pin such that the second pin limits how far the first support member can be slid toward the second support member and the threaded pin limits how far the first support member can be slid away from the second support member.

5. The support stand of claim 1, wherein the second support member is also slidably engaged with the top surface of the base such that the holding surface of the second support member can be slid toward or away from the holding surface of the first support member, and wherein the support stand further comprises a second securing apparatus capable of releasably securing the second support member to the base so as to prevent relative motion between the second member and the base.

6. The support stand of claim 5, wherein the second support member comprises an L-shaped bracket, a first leg of which extends substantially perpendicular to the base and has a face which forms the planar holding surface of the second support member, and a second leg of which has a face which is slidably engaged with the top surface of the base.

7. The support stand of 6, wherein the second leg of the second support member comprises a slot oriented so as to be substantially perpendicular to the face forming the planar holding surface of the second support member, and wherein the second securing apparatus comprises, a threaded pin protruding substantially perpendicular from the top surface of the base which has a distal end that extends through the slot of the second support member, and a threaded knob which is threadably mated to the threaded pin and which in a disengaged mode allows the second support member to be slid in relation to the base, and in an engaged mode wherein the knob is rotated down on the pin so as to compress the second leg of the second support member against the top surface of the base, prevents the second support member from sliding in relation to the base.

8. The support stand of claim 7, further comprising a second pin protruding substantially perpendicular from the top surface of the base which has a distal end that extends into the slot of the second support member, whereby the second pin prevents rotation of the second support member about the threaded pin.

9. The support stand of claim 8, wherein the second pin is disposed further outward on the base than the threaded pin such that the second pin limits how far the second support member can be slid toward the first support member and the threaded pin limits how far the second support member can be slid away from the first support member.

10. The support stand of claim 1, wherein the base has a bottom surface which is in contact with the ground or floor, and wherein the base is of sufficient size and shape so that whenever a display item is held in an upright position between the planar holding surfaces of the support members, it is prevented from tipping over.

11. The support stand of claim 10, wherein the top and bottom surfaces of the base have an elongated rectangular-shape and a longitudinal axis which extends substantially perpendicular to the planar holding surfaces of the support members.

12. The support stand of claim 10, wherein the top and bottom surfaces of the base have a substantially square shape.

13. The support stand of claim 1, further comprising at least two wheels, each of which is attached to a bottom surface of the base, so as to allow the support stand to be rolled about.

14. The support stand of claim 1, wherein the base is made of metal and coated with a rust-resistant plating material.

15. The support stand of claim 1, wherein each support member is made of metal and coated with a rust-resistant plating material.

16. A support stand, comprising:

a flat, planar, rigid base;

a single support member disposed on a top surface of the base having a single, planar holding surface oriented so as to be substantially perpendicular to the top surface of the base, and wherein the support member is slidably engaged with the top surface of the base such that the holding surface of the support member can be slid inward or outward on the base;

a first securing apparatus capable of releasably securing the support member to the base so as to prevent relative motion between that member and the base; and a second securing apparatus for attaching the support member to an item placed against the planar holding face of the support member, so as to hold the item in an upright position.

17. The support stand of claim 16, wherein the support member comprises an L-shaped bracket, a first leg of which extends substantially perpendicular to the base and has a face which forms the planar holding surface of the support member, and a second leg of which has a face that is slidably engaged with the top surface of the base.

18. The support stand of claim 17, wherein first leg of the support member comprises at least one through-hole disposed adjacent the distal end of the leg, and wherein the second securing apparatus comprises a screw, the head of which is retained by the at least one through-hole and the shaft of which is driven into the item being held in an upright position by the support stand.

19. A support stand, comprising:

a flat, planar, rigid base;

a pair of support members disposed on a top surface of the base, each support member having a single, planar holding surface oriented so as to be substantially perpendicular to the top surface of the base and opposed to each other, wherein a first of the pair of support members is slidably engaged with the top surface of the base such that the holding surface of the first support member can be slid toward or away from the holding surface of the second support member;

wherein the second support member is permanently affixed to the base; and a securing apparatus capable of releasably securing the first support member to the base so as to prevent relative motion between that member and the base.

20. The support stand of claim 19, wherein the first support member comprises an L-shaped bracket, a first leg of which extends substantially perpendicular to the base and has a face which forms the planar holding surface of the first support member, and a second leg of which has a face which is slidably engaged with the top surface of the base.

21. The support stand of claim 20, wherein the second leg of the first support member comprises a slot oriented so as to be substantially perpendicular to the face forming the planar holding surface of the first support member, and wherein the securing apparatus comprises, a threaded pin protruding substantially perpendicular from the top surface of the base which has a distal end that extends through the slot of the first support member, and a threaded knob which is threadably mated to the threaded pin and which in a disengaged mode allows the first support member to be slid in relation to the base, and in an engaged mode wherein the knob is rotated down on the pin so as to compress the second leg of the first support member against the top surface of the base, prevents the first support member from sliding in relation to the base.

22. The support stand of claim 21, further comprising a second pin protruding substantially perpendicular from the top surface of the base which has a distal end that extends into the slot of the first support member, whereby the second pin prevents rotation of the first support member about the threaded pin.

23. The support stand of claim 22, wherein the second pin is disposed further outward on the base than the threaded pin such that the second pin limits how far the first support member can be slid toward the second support member and the threaded pin limits how far the first support member can be slid away from the second support member.

24. The support stand of claim 19, further comprising at least two wheels, each of which is attached to a bottom surface of the base, so as to allow the support stand to be rolled about.

* * * * *

UNITED STATES PATENT AND TRADEMARK OFFICE

CERTIFICATE OF CORRECTION

PATENT NO. : 7,040,583 B1
APPLICATION NO. : 08/992504
DATED : May 9, 2006
INVENTOR(S) : Edward W. Holland et al.

It is certified that error appears in the above-identified patent and that said Letters Patent is hereby corrected as shown below:

Column 3,

Line 39, insert --flat-- after "continuous"

Column 4,

Line 47, insert --4-- after "3,"

Signed and Sealed this

Eleventh Day of July, 2006

JON W. DUDAS
*Director of the United States Patent and Trademark Office*